US007798178B2

(12) United States Patent
Vanthournout et al.

(10) Patent No.: US 7,798,178 B2
(45) Date of Patent: Sep. 21, 2010

(54) SHED FORMING DEVICE FOR A WEAVING MACHINE

(75) Inventors: Filiep Vanthournout, Heule (BE); Bram Vanderjeugt, Ypres (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 936 days.

(21) Appl. No.: 10/657,699

(22) Filed: Sep. 9, 2003

(65) Prior Publication Data

US 2005/0081940 A1 Apr. 21, 2005

(30) Foreign Application Priority Data

Sep. 9, 2002 (BE) ..... 2002/0525

(51) Int. Cl.
*D03C 3/00* (2006.01)

(52) U.S. Cl. ..... 139/59; 139/55.1

(58) Field of Classification Search ..... 139/59, 139/65, 55.1, 60, 62; 254/396
See application file for complete search history.

(56) References Cited

U.S. PATENT DOCUMENTS 5,139,052 A * 8/1992 Derudder ..... 139/65
5,353,846 A * 10/1994 Gheysen et al. ..... 139/65
5,540,262 A * 7/1996 Bassi et al. ..... 139/65
5,862,836 A * 1/1999 Himmelstoss ..... 139/65
2001/0004905 A1 * 6/2001 Puype et al. ..... 139/55.1

FOREIGN PATENT DOCUMENTS

| | | |
|---|---|---|
| DE | 2980264 | 4/1998 |
| EP | 1111107 | 6/2001 |
| FR | 2648159 | 12/1990 |

* cited by examiner

*Primary Examiner*—Shaun R Hurley
*Assistant Examiner*—Andrew W Sutton
(74) *Attorney, Agent, or Firm*—James Creighton Wray; Meera P. Narasimhan

(57) ABSTRACT

The invention relates to a shed forming device for a weaving machine, comprising two or more sets of hooks (2), which are provided with complementary hooks (2*a*, 2*b*) operating in conjunction with a pulley (40), the complementary hooks (2*a*, 2*b*) of one set of hooks (2) are operating in conjunction with one pulley (40) and a number of first pulleys (40*a*) of one or more first sets of hooks (20*a*) are provided in an upper row (100), and a number of second pulleys (40*b*) of one or more second sets of hooks (20*b*) are provided in a lower row (101). On the other hand, the invention relates to a weaving machine comprising a shed-forming device (1) as described above.

8 Claims, 3 Drawing Sheets

SHED FORMING DEVICE FOR A WEAVING MACHINE

This application claims the benefit of Belgian Application No. 2002/0525 filed Sep. 9, 2002.

BACKGROUND OF THE INVENTION

The invention relates to a shed forming device for a weaving machine, comprising two or more sets of hooks, which are provided with complementary hooks operating in conjunction with a tackle.

This device is more particularly used in two- or more-positions open-shed Jacquard machines.

This invention likewise relates to a weaving machine provided with such a shed forming device or Jacquard machine.

A Jacquard machine, or in a broader sense, a shed forming device, comprises one or more selection systems which are designed to select whether or not one or more hooks. When selected, a hook is taken along by a lifting element, being part of a set of lifting elements consisting of at least two lifting elements moving up and down in opposite phase.

Two or more complementary hooks form a set of hooks. Complementary hooks are hooks operating in conjunction, which by influencing one or more selection elements and which, by using lifting means, may be brought into different positions, so that the warp yarns on a weaving machine may be brought into different positions or at different heights according to the open-shed principle by means of pulley cords and pulley elements.

An important feature of a shed forming device is the footprint of a selection system, which may be defined in the following ways:

- the surface taken up by one selection system in a vertical projection of the device on a horizontal plane; or
- the product of the pitch in the longitudinal direction and the pitch in the cross direction, the "pitch" being the distance between the center lines of two selection elements situated next to one another.

Similar shed forming devices are generally known. Thus, in the European patent publication EP 0 188 074 a selection and guiding device for the hooks of an electronically controlled two-position open-shed Jacquard machine is described. The hooks are flexible and made of ferromagnetic material, and the selection element is an electromagnet. The electromagnet is able to bent the hooks to a first position in which the hook is taken along by a blade moving up and down and to a second position, where the hook (when selected) will hook onto a protrusion and therefore will be kept at a stationary height. In this manner a hook may be moved up and down at will or kept at a specific height.

Furthermore a three-position open-shed Jacquard machine is known from the Belgian patent BE 1 009 047, each selection system of which comprises two solenoids situated above one another. These solenoids are designed to act on two hooks operating in conjunction, which were made in two parts. The hooks may be moved up and down by two blade systems operating above one another. This device can be operated as a three-position open-shed Jacquard machine.

From FR 2 648 159 a selection device is known for an open-shed jacquard machine, in which two complementary sets of hooks and two selection elements are needed in order to realize the three positions of the shed.

In DE 29802064 a tackle system for a three-position Jacquard machine is described, in which two control elements have been provided each operating in conjunction with a complementary set of hooks and in which two pulleys, situated above one another, are disposed diagonally and crosswise, because they are each connected crosswise to a hook from each of the two complementary sets of hooks, through a cord running around their upper pulley wheel.

The disadvantage of this device is that, in order to realize the three positions, two controlling elements are required and in order to reach the three positions a pulley of the lower level has to operate in conjunction with a pulley of the upper level.

Similar Jacquard machines may be realized with a footprint of 8×22 $mm^2$, which is rather large. It causes the problem that the number of selection systems per Jacquard machine is rather restricted in this way, and that the dimensions of the Jacquard machine become too large when more selection systems are installed.

The Belgian patent application BE 1 013 193 offers a solution to this problem, in which a shed forming device for a weaving machine is described, comprising a number of combinations of at least to selection systems, with selection elements disposed one above the other respectively, each system comprising two hooks operating in conjunction and movable up and down by means of lifting means, which are selected by a selection element, so that they may be kept at a stationary height and where the hooks of various selection elements of a combination may be moved up and down independently from one another. This device therefore has lifting blades in two pieces moving two sets of hooks. These two sets of hooks are of a different length, so that each set of hooks may be controlled by a separate set of electromagnetic selection systems. Both sets of electromagnetic selection systems are installed above one another.

The problem of such a device is that the number of selection systems per unit of surface is practically doubled, but this provided said lifting blades in two pieces are used. Because of this doubling of the number of selection systems more pulleys are needed, because of which they have, either partly or all together, a smaller bearing diameter and either are installed next to one another and will have bearings with a smaller width or both. Because of this smaller width of the bearing and/or diameter of the pulleys, the life span will be shorter and the capacity as to speed and strength will be influenced in a negative sense.

Further disadvantages of this device are:

- lifting elements in two pieces are difficult to manufacture and expensive;
- because the blades are situated at two levels, half of the hooks have to be put through the lifting means, which increases the assembly time (and also makes the preassembly more difficult) and likewise will make possible replacements of parts in the Jacquard machine more difficult;
- the hooks are divided in two sets of hooks which are considerably different as to length, which requires special provisions for the longest hooks and causes more risks of inaccurate selections, damage and breakage;
- the two electromagnetic selection systems arranged above one another are situated in parts of the housing, which are substantially different in thickness, which causes the selection systems to react non-identically on these two levels;
- in order to avoid the various tackle cords from getting in touch with one another or impeding one another, special dispositions have to be respected which will complicate assembly and will cause more risks and mistakes during assembly;
- such a device requires a substantial installing height because the two sets of selection systems have to be arranged above one another.

SUMMARY OF THE INVENTION

Purpose of the invention is to provide a shed-forming device for a Jacquard machine not having the drawbacks mentioned above.

A further purpose of the invention is to provide a shed forming device for weaving machines, in which a smaller footprint is realized without using lifting blades in two pieces and using lifting means, which may be manufactured easily and, in a simple manner.

Another purpose is that both hooks and pulleys may be easily installed and that the installation of the pulleys may occur without substantially increasing the height of the Jacquard machine.

These purposes are achieved by providing a shed forming device for a weaving machine, comprising two or more sets of hooks which are provided with complementary hooks operating in conjunction with a pulley, but where the complementary hooks of one set of hooks are operating in conjunction with one pulley, and a number of first pulleys of one or more first sets of hooks are disposed in an upper row and a number of second pulleys of one or more second sets of hooks are disposed in a lower row.

In a preferred embodiment of a shed forming device according to the invention a first and a second adjacent set of hooks are overlapping one another, at least partly, when projected on a horizontal plane, operating in conjunction with a first pulley from the upper row and a second pulley of the lower row respectively.

This has the advantage that the pulley cords of the first pulleys from the upper row extend between the pulley cords of the second pulleys from the lower row.

In an advantageous embodiment of a shed forming device according to the invention, the distance after projection on a horizontal plane between a first set of hooks operating in conjunction with a first pulley from the upper row and a second adjacent set of hooks operating in conjunction with a second pulley from the lower row is shorter than the total of half the width of said first pulley and half the width of said second pulley.

In a more advantageous embodiment of a shed forming device according to the invention, said first and second pulley are shifted over half a pitch with respect to one another. By pitch is meant here the distance between the centerlines of two adjacent pulleys.

In the most advantageous embodiment of a shed forming device according to the invention, said first and second pulleys are provided with one or more pulley cords and said first pulleys are practically resting against one another and said second pulleys are resting practically against one another, so that the pulley cords connecting the complementary hooks of the second sets of hooks may extend upwards over an upper pulley wheel of the two lower pulleys in the recesses of two adjacent first upper pulleys and the pulley cords which are connected to one or more heddles and return springs of a Jacquard weaving machine may extend downwards over a lower pulley wheel of the first upper pulleys in the recesses of two adjacent lower pulley.

This has the advantage that the pitch may be kept even smaller.

In a preferred embodiment of a shed-forming device according to the invention, the device is provided with single lifting elements in order to take along the sets of complementary hooks.

Preferably, the device is used on a two- or more-position open-shed Jacquard machine.

The invention will now be further explained on the basis of the following detailed description of a preferred shed-forming device for a weaving machine according to the present invention. This description is only intended to give a clarifying example and to emphasize the further advantages and particulars of the present invention and therefore may never be interpreted as a restriction of the field of application of the invention or of the patent rights demanded for in the claims.

In this detailed description reference is made by means of reference numbers to the attached drawings, where:

BRIEF DESCRIPTION OF THE DRAWINGS

FIG. 1A is representing the housing on which the pulley wheels have been provided;

FIG. 1B is representing the pulley wheels;

DETAILED DESCRIPTION OF THE PREFERRED EMBODIMENTS

Figure 1A:
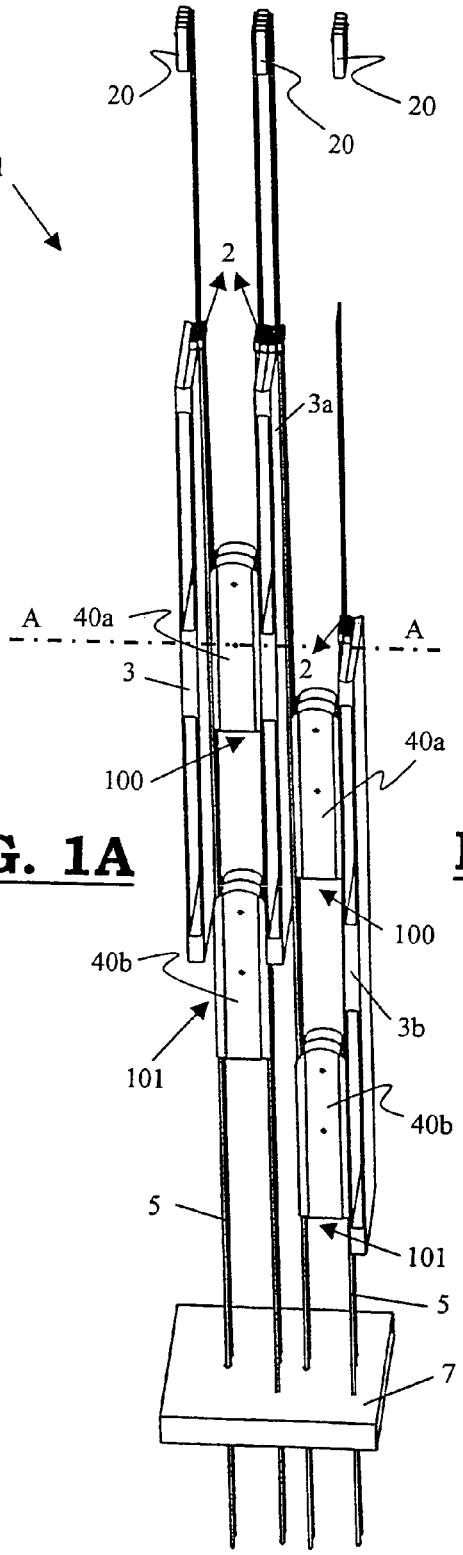
FIGS. 1A and 1B represent a perspective front view of a shed-forming device according to the invention.
Figure 1B:
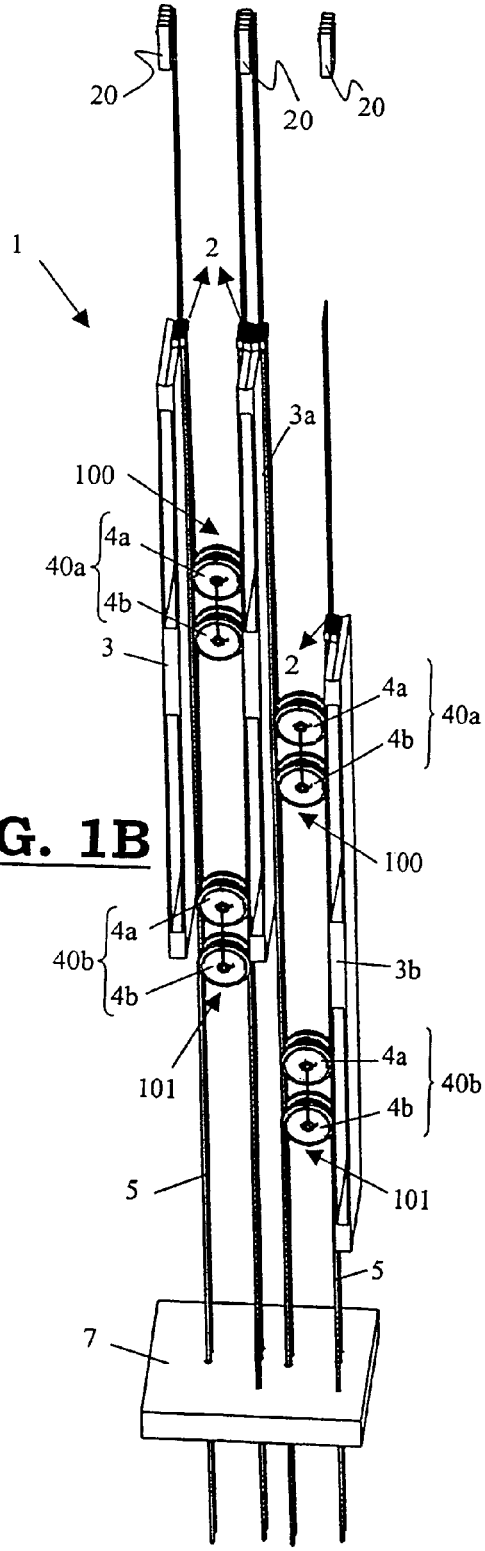

A shed forming device (1) according to the invention, as represented in the FIGS. 1A and 1B comprises one or more selection systems (20) being provided with one or more hooks (2) whether or not to be selected. When selected, a hook (2) is taken along by a lifting element, more specifically carried out as a blade (3). These blades (3) are of the single type.

Figure 2:
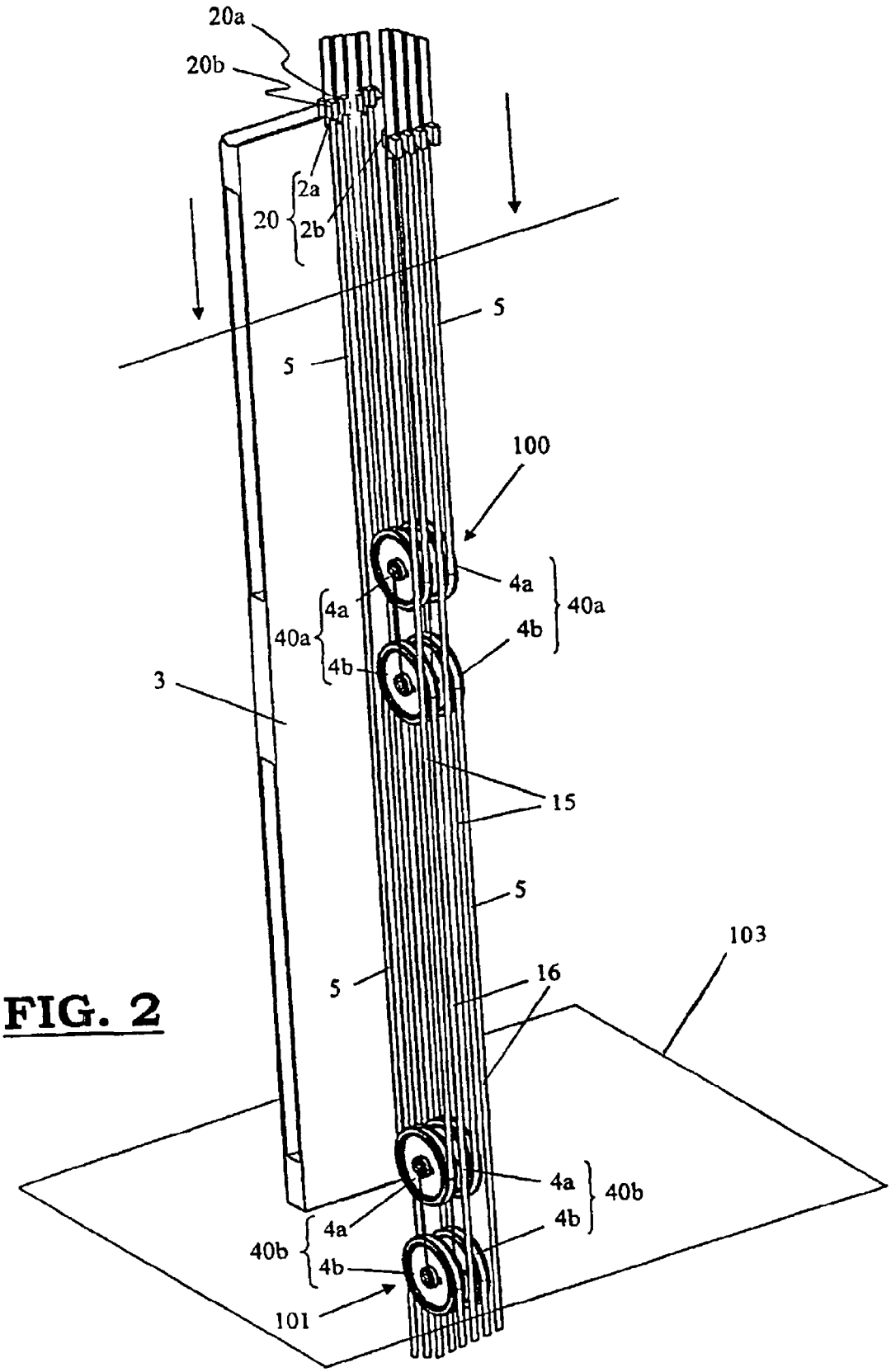
FIG. 2 is a perspective front view of a part of the shed-forming device according to the invention, the sets of hooks, pulley wheels and a blade being represented.
Figure 3:
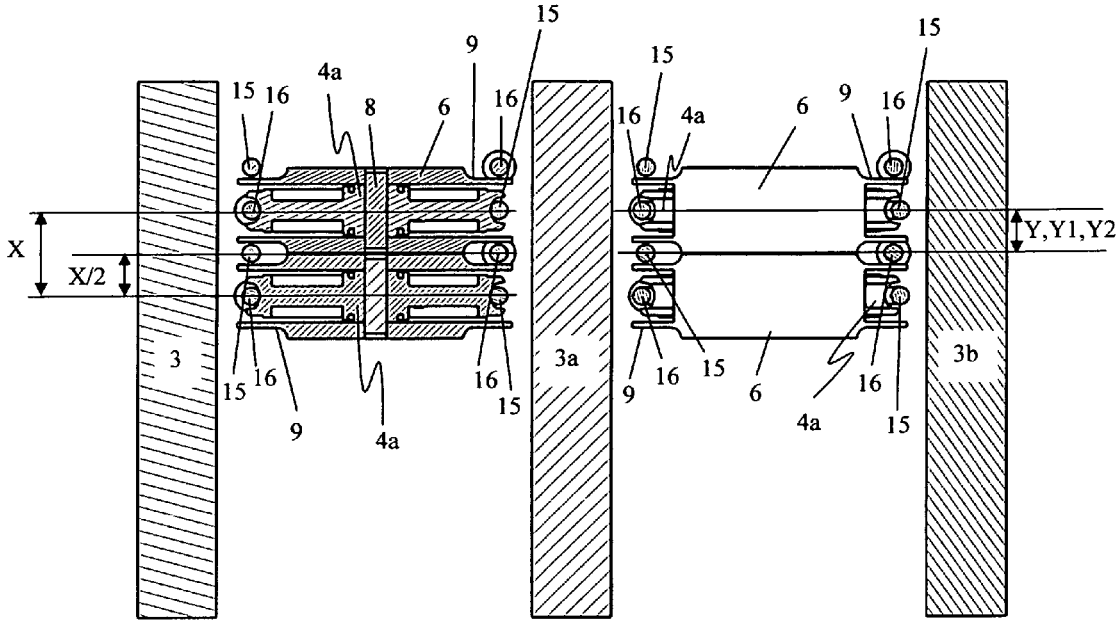
FIG. 3 represents a cross-section according to the line A-A as indicated in FIG. 1A.

Two or more complementary hooks (2*a*, 2*b*) form a set of hooks (20) (as represented in FIG. 2). Complementary hooks (2*a*, 2*b*) are hooks operating in conjunction, which may be brought into various positions, by influencing one or more selection elements (20) and by using lifting means (3), so that the warp yarns may be brought into different positions or levels according to the open shed principle by means of pulley cords and pulleys (40). A pulleye (40) is constituted of two pulley wheels, namely an upper pulley wheel (4*a*) and a lower pulley wheel (4*b*), which are interconnected. As represented in FIG. 3, a pulley wheel (4*a*, 4*b*) is rotatably installed on a shaft (8). On the outside of a pulley wheel (4*a*, 4*b*) runs a pulley cord (5, 15, 16). Over the upper pulley wheel (4*a*) a pulley cord (15) is running which is connected to the complementary hooks (2*a*, 2*b*) of a set of hooks, whereas round the lower pulley wheel (4*b*) a pulley cord (16) is running which is connected to one or more heddles and return springs of a Jacquard machine (not represented in the figure). The pulleys (40) are provided in a housing (6), as represented in the FIGS. 1A and 3. On one side, the pulley wheels (16) are running through the bottom board (7) of the weaving machine.

A number of first pulleys (40*a*) of one or more first sets of hooks (20*a*) are provided in an upper row (100) and a number of second pulleys (40*b*) of one or more second sets of hooks (20*b*) are provided in a lower row (101). The said pulleys (40*a*, 40*b*) being installed in such a manner that a first (20*a*) and a second adjacent set of hooks (20*b*), operating in conjunction with a first pulley (40*a*) and a second pulley (40*b*) respectively, are overlapping one another, at least partly, when projected on a horizontal plane (103). The distance between a first set of hooks (20*a*) operating in conjunction with a first pulley (40*a*) from the upper row (100) and a second set of hooks (20*b*) operating in conjunction with a pulley (40*b*) from the lower row (101) is shorter than the total of half the width of said first pulley (40*a*) and half the width of said second pulley (40*b*). In this embodiment all pulleys (40) have the same dimensions. Preferably, said first (40*a*) and second pulley (40*b*) are shifted over half a pitch (X/2) with respect to one another. By pitch is meant the distance between the centerlines of two adjacent pulleys (40*a* or 40*b*), as represented in FIG. 3.

Furthermore, in order to obtain an even smaller pitch, it is possible to carry out the installation of the pulleys such as represented in FIG. 2, that the adjacent first pulleys (40*a*) from the upper row (100) are practically resting against one another, and the adjacent second pulleys (40*b*) from the lower row (101) are practically resting against one another, as represented in FIG. 3. The pulleys (40*a*, 40*b*), more particularly the housings (6) of the pulleys (40*a*, 40*b*) being provided with a recess (9). These recesses (9) are provided so that the pulley cord (15) connecting the complementary hooks (2*a*, 2*b*) may extend upwards in the recesses (9) of two adjacent first upper pulleys (40*a*) on the one hand, and the pulley cord (16) connected to one or more heddles and return springs (not represented in the figure) of the Jacquard weaving machine over the lower pulley wheel (4*b*) of the first upper pulleys (40*a*), may extend upwards in the recesses (9) of two adjacent second lower pulleys (40*b*).

Compared to the former solution to increase the pitch, where lifting elements (3) in two pieces were used (see for instance BE 1 013 193), this embodiment has the advantage that the pulley wheels are identical both in diameter and in length, so that the bearings which are used have a same life span and capacity as to speed and strength.

Furthermore, installing the pulleys (40) in such a manner has the advantage that lifting means can be used, which may be simply and easily manufactured. Also both the hooks (2) and the pulleys (40) may be easily installed which may be done by means of a preassembly or in an automated form.

An additional advantage of such an embodiment is that the hooks (2), the electromagnetic selection elements and the pulleys (40) are all the same for the entire device. Only the pulley cords (5, 15, 16) are of a different length. Moreover, the electromagnetic selection elements are identically constituted for the entire device.

A significant advantage of the embodiment described above is that the pulleys (40) may be installed in two rows (100, 101) situated above one another, without substantially increasing the height of the device. The stiffness required for the lifting means requires a height enabling the two rows of pulleys (40*a*, 40*b*) to be situated above one another without any additional loss in height.

What is claimed is:

1. Shed forming device for a weaving machine, comprising two or more sets of hooks (2) which are provided with complementary hooks (2*a*, 2*b*), operating in conjunction with a pulley (4) by means of a plurality of pulley cords (15), wherein the complementary hooks (2*a*, 2*b*) of one set of hooks (2) are operating in conjunction with one pulley (40), and a number of first pulleys (40*a*) of one or more sets of hooks (20*a*) are provided continuously in an upper row (100), and a number of second pulleys (40*b*) of one or more second sets of hooks (20*b*) are provided continuously in a lower row (101), wherein each of a first pulley (40*a*) and a second pulley (40*b*) are connected with a complementary set of hooks (20*a*, 20*b*), wherein both complementary hook sets (20*a*, 20*b*) are adjacent, and wherein the first and the second pulleys (40*a*, 40*b*) overlap one another, at least partly, when projected on a horizontal plane, and wherein the plurality of pulley cords are disposed in the upper row and in the lower row, and wherein the first pulleys of the upper row have a bottom position always remaining higher than a top position of the second pulleys of the lower row.

2. Shed forming device for a weaving machine, comprising two or more sets of hooks (2) which are provided with complementary hooks (2*a*, 2*b*), operating in conjunction with a pulley (40), wherein the complementary hooks (2*a*, 2*b*) of one set of hooks (2) are operating in conjunction with one pulley (40), and a number of first pulleys (40*a*) of one or more sets of hooks (20*a*) are provided in an upper row (100), and a number of second pulleys (40*b*) of one or more second sets of hooks (20*b*) are provided in a lower row (101), wherein a first pulley (40*a*) and a second pulley (40*b*) which each are connected with a complementary set of hooks (20*a*, 20*b*), wherein both complementary hook sets (20*a*, 20*b*) are adjacent, and wherein the first and second pulleys (40*a*, 40*b*) will overlap one another, at least partly, when projected on a horizontal plane, and wherein the first pulleys of the upper row have a bottom position always remaining higher than a top position of the second pulleys of the lower row.

3. Shed forming device for a weaving machine, comprising two or more sets of hooks (2) which are provided with complementary hooks (2*a*, 2*b*), operating in conjunction with a pulley (40), wherein the complementary hooks (2*a*, 2*b*) of one set of hooks (2) are operating in conjunction with one pulley (40), and a number of first pulleys (40*a*) of one or more sets of hooks (20*a*) are provided in an upper row (100), and a number of second pulleys (40*b*) of one or more second sets of hooks (20*b*) are provided in a lower row (101), wherein a first pulley (40*a*) and a second pulley (40*b*) which each are connected with a complementary set of hooks (20*a*, 20*b*), wherein both complementary hook sets (20*a*, 20*b*) are adjacent, and wherein the first and second pulleys (40*a*, 40*b*) will overlap one another, at least partly, when projected on a horizontal plane, wherein, after projection on a horizontal plane, the distance (Y) between a first set of hooks (20*a*) operating in conjunction with a first pulley (40*a*) from the upper row (100) and a second adjacent set of hooks (20*b*) operating in conjunction with a second pulley (40*b*) from the lower row (101) is shorter than the total of half the width (Y1) of said first pulley (40*a*) and half the width (Y2) of said second pulley (40*b*).

4. Shed forming device for a weaving machine, comprising two or more sets of hooks (2) which are provided with complementary hooks (2*a*, 2*b*), operating in conjunction with a pulley (40), wherein the complementary hooks (2*a*, 2*b*) of one set of hooks (2) are operating in conjunction with one pulley (40), and a number of first pulleys (40*a*) of one or more sets of hooks (20*a*) are provided in an upper row (100), and a number of second pulleys (40*b*) of one or more second sets of hooks (20*b*) are provided in a lower row (101), wherein said first (40*a*) and second pulley (40*b*) are shifted widthwise over half a pitch with respect to one another.

5. Shed forming device according to claim 4, wherein said first (40*a*) and second pulley (40*b*) are each provided with one or more pulley cords (5, 15, 16) and in that said adjacent first pulleys (40*a*) are practically resting against one another and said adjacent second pulleys (40*b*) are practically resting against one another and are provided with a recess (9), so that the pulley cords (15) connecting the complementary hooks (2*a*, 2*b*) of the second sets of hooks (20*b*) may extend upwards over an upper pulley wheel (4*a*) of the second lower pulleys (40*b*), in the recesses (9) of two adjacent first upper pulleys (40*a*) and the pulley cords (16) being connected to one or more heddles and return springs of a Jacquard weaving machines over a lower pulley wheel (4*b*) of the first upper pulleys (40*a*) may extend downwards in the recesses (9) of two adjacent lower pulleys (40*b*).

6. Shed forming device according to claim 1, wherein the device is provided with single lifting elements (3) in order to take along the sets of hooks (20) on selection.

7. Shed forming device according to claim 1, wherein the device (1) is used in a two- or more-position open shed Jacquard machine.

8. Weaving machine comprising a shed forming device (1) according to claim 1.

* * * * *